US005092795A

United States Patent [19]

Kitagawa

[11] Patent Number: 5,092,795

[45] Date of Patent: Mar. 3, 1992

[54] ELECTRICAL JACK

[75] Inventor: Toshiya Kitagawa, Kashiwara, Japan

[73] Assignee: Hosiden Corporation, Yao, Japan

[21] Appl. No.: 597,170

[22] Filed: Oct. 15, 1990

[30] Foreign Application Priority Data

Oct. 17, 1989 [JP] Japan ..... 1-121993[U]

[51] Int. Cl.[5] ..... H01R 17/18

[52] U.S. Cl. ..... 439/668; 439/669

[58] Field of Search ..... 439/668, 669, 744, 746

[56] References Cited

U.S. PATENT DOCUMENTS

| | | | |
|---|---|---|---|
| 2,717,367 | 9/1955 | Puerner | 439/668 |
| 3,435,163 | 3/1969 | Bailey et al. | 439/668 |
| 4,392,708 | 7/1983 | Bailey et al. | 439/668 |
| 4,493,526 | 1/1985 | Masuda | 439/668 |
| 4,598,970 | 7/1986 | Takihara | 439/668 |
| 4,725,239 | 2/1988 | Shichida | 439/668 |
| 4,867,708 | 9/1989 | Iizuka | 439/669 |

*Primary Examiner*—Larry I. Schwartz
*Assistant Examiner*—Hien D. Vu
*Attorney, Agent, or Firm*—Jones, Tullar & Cooper

[57] ABSTRACT

A jack of the present invention has a contact strip arranged on a U-shaped metal member which is fitted astride onto a body thereof and another contact strip arranged on a seat plate which is inserted into the interior space of the body from the rear end. Accordingly, fewer seat plates are provided for insertion into the body as compared with the number of contact strips, and the interior space of the body can thus be reduced. Also, the number of openings arranged in the body for passing terminals of their respective seat plates through can be reduced thus allowing the body not to experience a reduction in its physical strength. As the side walls of the body are interposed between the U-shaped metal member and the seat plates, the body retains its physical strength even if the walls are reduced in thickness.

23 Claims, 4 Drawing Sheets

ELECTRICAL JACK

BACKGROUND OF THE INVENTION

1. Field of the Invention

The present invention relates to a surface mounting type electrical jack having a plurality of terminals which correspond with contact strips provided in a body of the jack and are arranged with the lower surfaces thereof flush precisely or approximately with the bottom of the body. The contact strips of the jack are provided with contacts arranged respectively for contact with a plurality of axially spaced corresponding contacts of a plug which is inserted into the jack. Each terminal of the jack will be soldered to a circuit board in an overlapping arrangement in the pattern of a circuit.

2. Description of the Prior Art

A prior art surface mounting type jack is provided having contact strips arranged integrally on seat plates respectively which have corresponding terminals and are disposed in the interior space of a body of the jack. The terminals of their respective seat plates extend from slit openings provided in the side walls of the body to the outside of the same.

Such a prior art surface mounting type jack which has a plurality of slit openings provided in the side walls of a body thereof thus to allow the terminals to extend outwardly through the slit openings, needs to be arranged in which the slit opening are slotted open extensively from the rear end to the front end of the body for facilitating the insertion of the plural seat plates with the contact strips into the interior space of the body. However, the arrangement of providing a corresponding number of long slit openings to the terminals in the wall of the body will cause a decrease in the physical strength of the body. Particularly, for achievement of the reduced size of the jack by decreasing the wall thickness of the body, and thus maintaining the overall size to a minimum, it will be a great drawback to have the strength of the body decline due to the existence of the extensive slit openings.

Conventional jack of no mounting type are disclosed in Japanese Utility-model laid-open publication No. 48-27751 and Japanese Patent laid-open publication No. 61-82694.

A jack disclosed in publication No. 48-27751 is shown in FIG. 6 having a plurality of seat plates, which have contact strips respectively, all inserted through the rear end of a body 100 for installation within the body 100. The terminal 110 of each seat plate extends rearward from the rear end of the body 100. More specifically, the seat plates with the contact strips, except their respective terminals 110, are fully accommodated in the interior space of the body 100.

The jack disclosed in the Japanese laid-open publication No. 61-82694 is shown in FIG. 7. The jack includes a plurality of U-shaped metal members 120, each of which has a couple of leg portions 122, 122 bent along both ends of a center portion 121 thereof, arranged along the length of and fitted astride each other onto a body 100' of the jack. The center portion 121 of each U-shaped metal member 120 incorporates a contact point 123 provided at a given place thereof and extending to the interior space of the body 100' through an opening arranged in the upper surface of the same. More particularly, the U-shaped metal members 120 provided with the contact points 123 and having also terminals 124 extending from the leg portions 122 thereof are all disposed in the outside of the body 100', but excluding their respective contact points 123.

When the prior art described in publication No. 48-27751 is applied to a surface mounting type jack, an advantage is that it is unnecessary to have openings arranged in the body for the terminals extending through. However, since the plural seat members with the contact strips are all disposed within the body except their respective terminals 110, there is needed an extensive space in the body for accommodating the desired number of the seat plates with the contact strips. When the jack is reduced in size, such an interior space is no longer available and the positioning of the contact strips relative to the contact points of a plug to be inserted into the body will thus be troublesome. Hence, it is not a good idea to use the prior art described in this publication for further reduction of the size of a surface mounting type jack.

The jack described in publication No. 61-82694 is arranged in which the U-shaped metal members 120 with the terminals 124 extending from the leg portions 122 are all disposed on the outside of the body 100' but excluding their respective contact points 123 which extend into the interior space of the body 100'. Accordingly, as the number of the contact points 123 increases, the metal members 120 are increased in number and thus, the length of the body 100' will never be shortened limiting the size reduction of the jack. If the metal member 120 is reduced in width for reducing the overall length of the body 100', the urging force of the planar portion 121 of each U-shaped metal member 120 will decrease. When the urging force is lowered, the contact pressure of the contact point of the U-shaped metal member 120 against the contact of a plug which is inserted into the body 100' will decrease and consequently, the contact reliability will decline. Also, it is not a good idea to employ the prior art described in this publication for reducing the size of a surface mounting type jack.

SUMMARY OF THE INVENTION

It is, therefore, a primary object of the present invention to provide a surface mounting type electrical jack in which at least one of the contact strips which are mounted to a body of the jack is inserted into the interior space of the body through the upper surface and the other contact strip is inserted into the same from the rear end so that the interior space of the body for accommodating the plural contact strips can be minimized in order to reduce the overall size of the jack.

It is another object of the present invention to provide a surface mounting type jack in which the physical strength of a body, the side walls of which are reduced in thickness, can remain unchanged in addition to the advantage described above.

For achievement of the foregoing objects, a surface mounting type jack according to the present invention which has a body incorporating an interior space therein, contact strips disposed in the body which corresponds with a plurality of axially spaced contacts of a plug which is inserted into the interior space of the body, and terminals arranged to correspond with their respective contact strips and having lower surfaces thereof precisely or approximately flush with the bottom of the body at the outside of the body, comprises:

at least one metal member of U shape having leg portions extending from both sides of a center portion and fitted astride each other onto the body with the leg portions engaging the outer surfaces of the body;

one of the contact strips arranged by cutting out and lifting up a segment of the metal member;

an opening provided in the body for inserting the contact of the contact strip into the interior space of the body;

the terminals arranged on the leg portions of the metal member; and a seat plate inserted into the interior space of the body from the rear end and having the terminal extending outwardly from the body and the remaining contact strip which corresponds with the contact of a plug, within the body.

The jack has a lesser number of the seat plates for installation within the body than the prior art jack disclosed in publication No. 48-27751 thus allowing the interior space of the body to be reduced. Also, some of the contact strips are arranged on the leg portions of the U-shaped metal member, whereby the number of slit openings provided in the body can be reduced as compared with that of the prior art surface mounting type jack. As a result, reduction in the physical strength of the body caused by the existence of a number of slit openings will be prevented. Furthermore, not all the contact strips are arranged on the U-shaped metal members, as compared with those of the jack disclosed in publication No. 61-82694, whereby the entire length of the body will not increase even when the number of the contact strips is increased. It is also understood that the contact strip arranged by cutting out and lifting up segment of the folding center portion of the U-shaped metal member has an urging force which yieldingly acts on its contact point.

Therefore, the jack of the present invention will easily be reduced in size as compared with any prior art jack without sacrificing the physical strength of the body. Also, all the contact strips can be initiated to come in direct contact with the corresponding contacts of a plug at an appropriate contact pressure, thus ensuring higher reliability in the contact action.

Another surface mounting type jack according to the present invention may have at least one side wall of a body thereof interposed between the leg portion of a U-shaped metal member and either a seat plate or a contact strip arranged on the seat plate.

This jack can also allow the body to have a desired physical strength even if its side wall is reduced in thickness and its overall size will thus be minimized with ease.

Other features and advantages of the present invention will be apparent from the following description of one preferred embodiment.

DETAILED DESCRIPTION OF THE PREFERRED EMBODIMENTS

Figure 1:
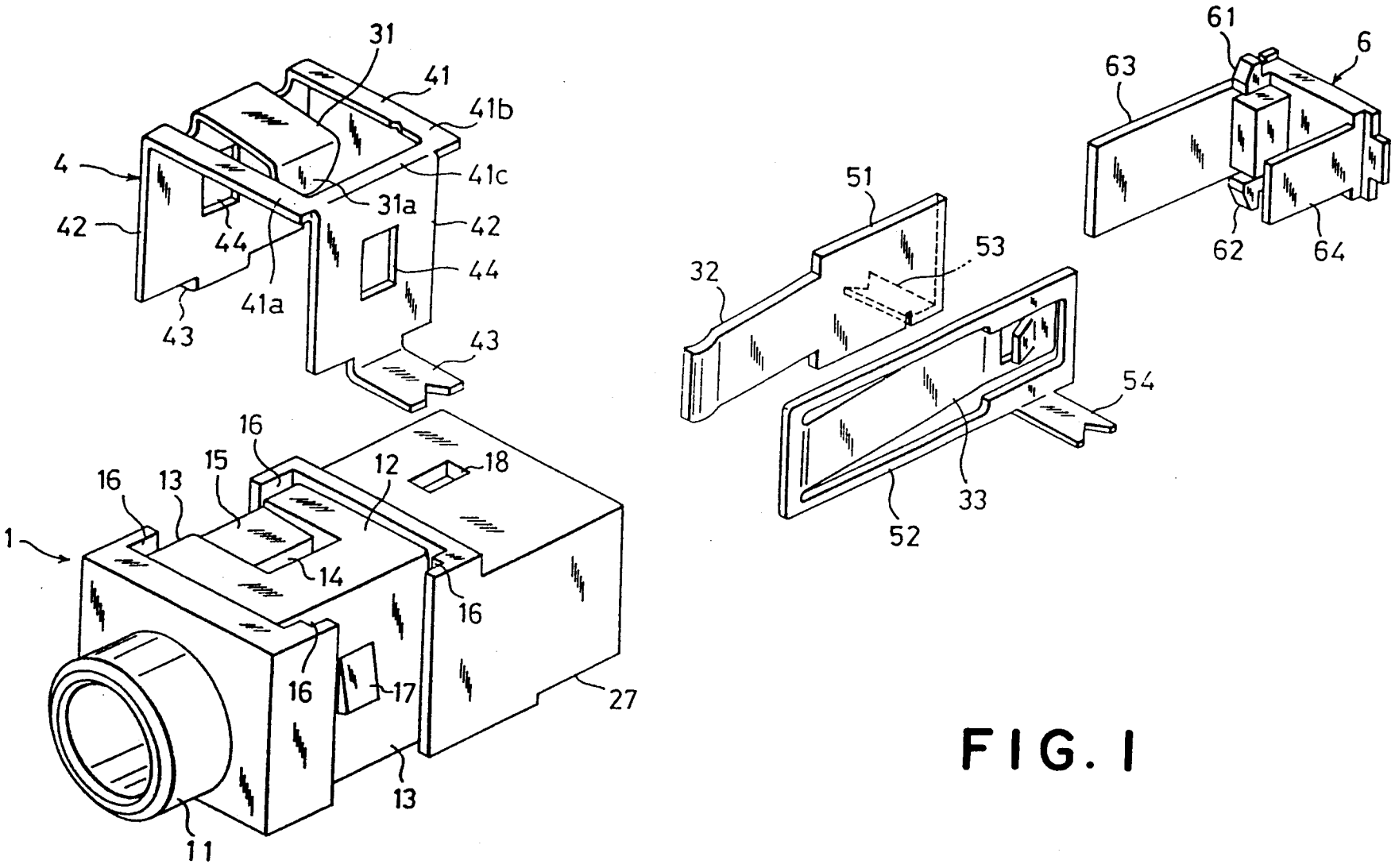
FIG. 1 is an exploded perspective view of a jack according to the present invention.
Figure 2:
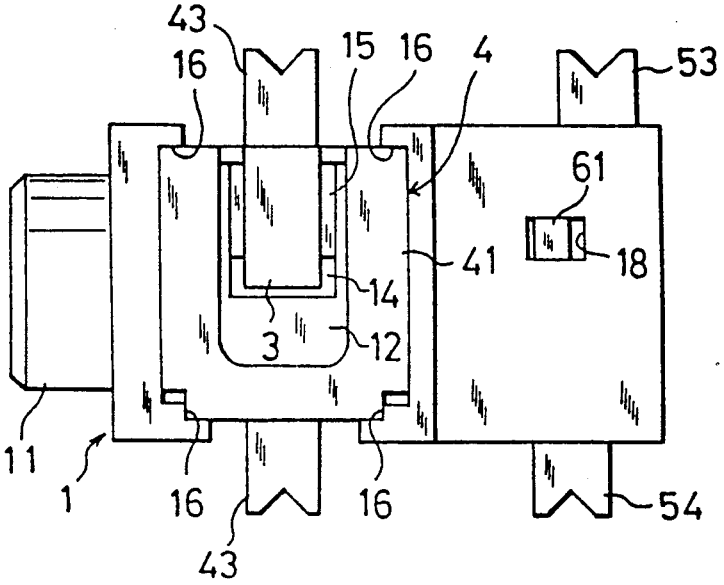
FIG. 2 is a plan view of the same.
Figure 3:
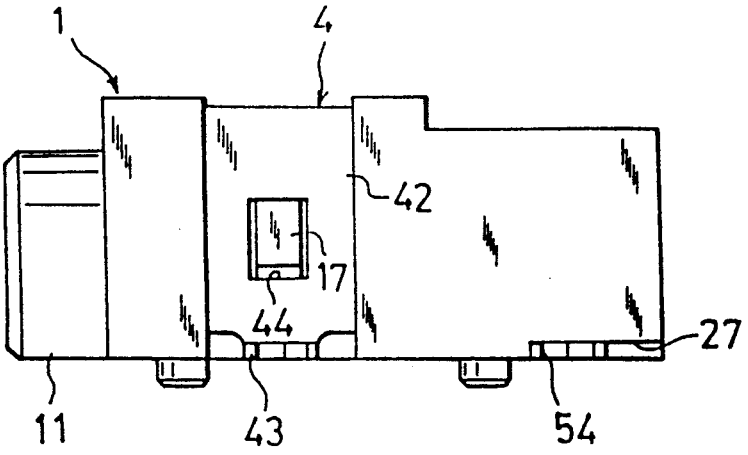
FIG. 3 is a side view of the same.
Figure 4:
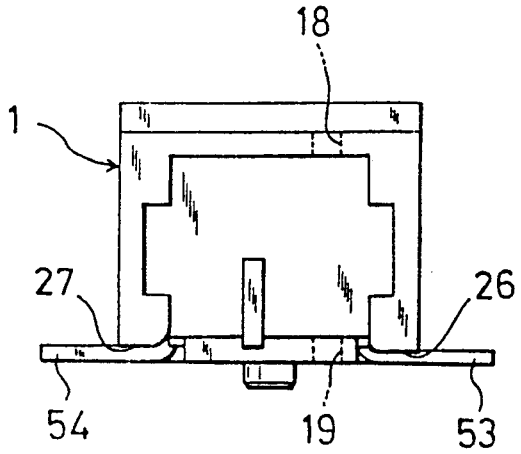
FIG. 4 is a rear view of the same.

As shown in FIGS. 1 to 5, an electrical jack according to the present invention is mainly consists of a body 1 made of insulating material such as synthetic resin, a metal member 4 of approximately U shape in the front view having a contact strip 31, a metal seat plate 51 of planar shape having a contact strip 32, a four-sided metal seat plate 52 having a contact strip 33 between its sides, and a cover 6 made of insulating material, e.g. synthetic resin. Contact points of the respective contact strips 31, 32, and 33 are arranged to correspond with the axially spaced contact points of a plug which is inserted into the jack.

The body 1 has at its front end a cylindrical portion 11 thereof through which a plug is inserted. There are recesses 12, 13, and 13 arranged in the upper, left, and right surfaces of the body 1 respectively. The upper recess 12 is provided with a rectangular opening 14 and a support surface 15 which is arranged to slope downwardly to one side of the opening 14. Each of the left and right recesses 13, 13 of the body 1 is incorporated with vertically extending grooves 16, 16 formed in the front and rear inner walls thereof. Also, an engaging projection 17 is arranged in the central region of each recess 13. The body 1 has two square openings 18 and 19 arranged in the rearward regions of the upper and lower surfaces thereof respectively (see also FIG. 4).

The metal member 4 has a folding center portion 41 thereof incorporated at both ends with leg portions 42, 42, bent away therefrom thus forming a U shape. The center portion 41 is notched out while leaving front, rear, and side ends 41*a*, 41*b*, and 41*c* thereof. The leg portions 42, 42 have engaging openings 44, 44 arranged in the center thereof respectively and are incorporated at their lowermost end with outwardly bent terminals 43, 43.

The contact strip 31 is arranged by cutting out and lifting up a segment of the center portion 41 into a bent form, which is connected at its proximal end to the upper end of the leg portion 42 extending from one side end, where an edge is absent, of the center portion 41.

The U-shaped metal member 4 is fitted onto the body 1 with its left and right leg portions 42, 42 astride each other and inserted into the grooves 16, 16 of the body 1. Simultaneously, the engaging projections 17, 17 of the body 1 are engaged with the engaging openings 44, 44 of their respective leg portions 42, 42 for fastening. While the U-shaped metal member 4 is fixedly mounted to the body 1, its center portion 41 and leg portions 42, 42 are fully accommodated in the upper and side recesses 12, 13, 13. Also, the contact strip 31 is securely disposed with its proximal end supported by the support surface 15 and its distal end inserted through the opening 14 into the interior space of the body 1 across which the plug will be extended. The contact strip 31 which remains urged by a preload is supported by the support surface 15 so that a contact tongue 31*a* of the contact strip 31 can be positioned at a given location. The bottom of the terminals 43, 43 is arranged precisely or approximately flush with the lower surface of the body 1.

The U-shaped metal member 4 may fixedly be mounted to the body 1 in close engagement with the use of e.g. engaging fingers provided on the leg portions of the metal member 4 for engagement with recesses arranged in the body 1 or directly nailing down into the body 1.

The planar seat plate 51 is provided for mounting in a vertical arrangement and has an outwardly bent terminal 53 arranged in the rear lower end thereof. The contact strip 32 extends frontward from the front end of the seat plate 51.

Figure 5:
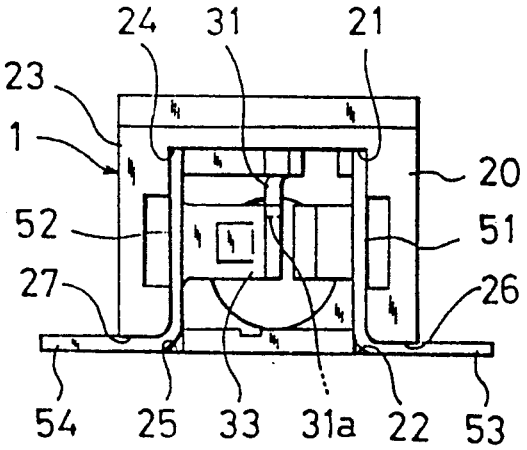
FIG. 5 is a rear view of the same showing a cover removed.
Figure 6:
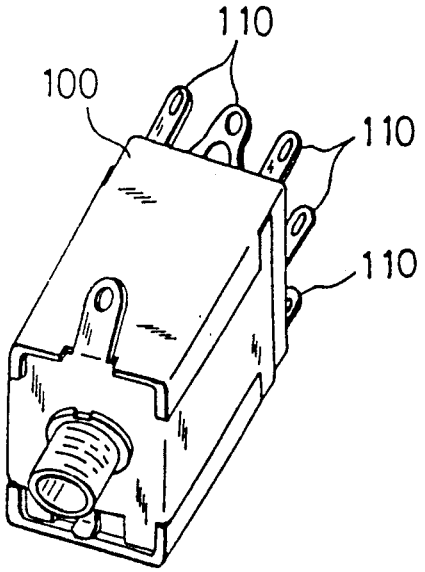
FIG. 6 (PRIOR ART)
FIG. 6 is a perspective view of a prior art jack of a non surface mounting type.
Figure 7:
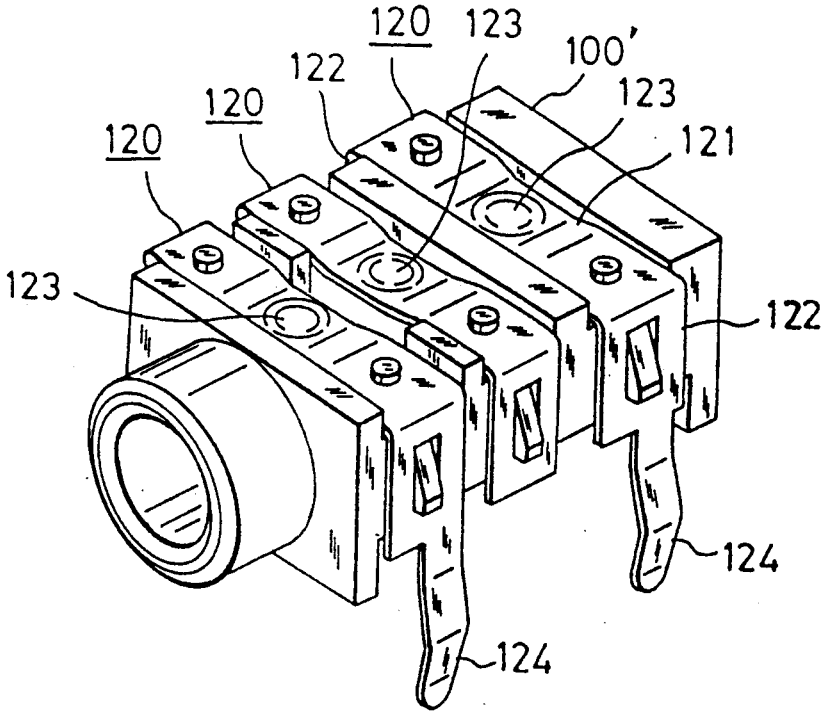
FIG. 7 (PRIOR ART)
FIG. 7 is a perspective view of another prior art jack of a non surface mounting type.

The seat plate 51 is inserted with the contact strip 32 facing forward into the interior of the body 1 from an opening provided in the rear end of the same. As shown in FIG. 5, the seat plate 51 is positioned so as to come into direct contact with the inner surface of a side wall 20 of the body 1. For securing the seat plate 51 in its insertion position, grooves 21 and 22 are arranged in the upper and lower inner surface of the side wall 20 of the body 1, respectively. Accordingly, the seat plate 51 is positioned in contact with the inner surface of the side wall 20 when inserted along the grooves 21 and 22. Also, the seat plate 51 extends up to the recess 13 arranged at one side so that a side wall of the body 1 having the recess 13 is interposed between the seat plate 51 and the leg portion 42 of the U-shaped metal member 4. As a result, the side wall which has a lesser thickness than the other regions of the body 1 due to the existence of the recess 13, is reinforced by the seat plate 51 and the leg portion 42 thus allowing the body 1 to have a necessary strength.

Similarly, the rectangular seat plate 52 is arranged for mounting in a vertical arrangement and has an outwardly bent terminal 54 formed in the rear lower end thereof to extend opposite to the terminal 53. The contact strip 33 of the seat plate 52 extends from the front end of the same towards the rear end while also extending inwardly. The contact strip 33 is formed by cutting out and lifting up a segment of the center region of the seat plate 52.

The seat plate 52 is also inserted with the proximal end of the contact strip 33 facing forward into the interior of the body 1 from the rear opening of the same. As shown in FIG. 5, the seat plate 52 is positioned so as to come into direct contact with the inner surface of a side wall 23 of the body 1. For securing the seat plate 52 to the insertion place, grooves 24 and 25 are arranged in the upper and lower inner surface of the side wall 23 of the body 1, respectively. Accordingly, the seat plate 52 is positioned in contact with the inner surface of the side wall 23 when inserted along the grooves 24 and 25. Also, the seat plate 52 extends up to the recess 13 arranged at one side so that a corresponding side wall of the body 1 having the recess 13 is interposed between the seat plate 52 and the other leg portion 42 of the U-shaped metal member 4. As a result, the side wall which has a lesser thickness than the other regions of the body 1 due to the existence of the recess 13, is reinforced by the seat plate 52 and the leg portion 42 thus allowing the body 1 to have a necessary strength.

The terminals 53 and 54 arranged on their respective seat plate 51 and 52 extend from the body 1 to the outside through slit openings 26 and 27 of the body 1, respectively.

The cover 6 has a pair of upper and lower resilient engaging fingers 61 and 62 and can be mounted to the body 1 by being fitted into the rear opening of the body 1 with the engaging fingers 61 and 62 engaged with the square openings 18 and 19 of the body 1, respectively. When the cover 6 is mounted to the body 1, it presses against the rear ends of the seat plates 51 and 52 which are in turn fastened to the body 1. Simultaneously, a couple of forward tabs 63 and 64 arranged integral with the cover 6 come into direct contact with the inner surfaces of the seat plates 51 and 52 for reinforcement.

Also, if the seat plates 51 and 52 have engaging projections arranged on the upper or lower ends thereof for bite engagement with the inner surface of the body 1, they will be fastened securely to the body 1 without the use of the cover 6.

The three contact strips 31, 32 and 33 in the embodiment correspond with the three axially spaced contact points of a plug which is to be inserted into the jack. One of them may serve as a grounding contact.

According to the arrangement of the jack described above, the contact strip 31, one of the three contacts, is arranged on the U-shaped metal member 4 and the other two contact strips 32 and 33 are arranged on their respective seat plates 51 and 52, the U-shaped metal member 4 is fitted astride onto the body 1, and the contact strip 31 is inserted into the interior space of the body 1 and the other two contact strips 32 and 33 are inserted into the same from the rear end of the body 1 together with their respective seat plates 51 and 52. This allows the seat plates disposed in the interior space of the body 1 to be reduced in number as compared with an arrangement having the contacts 31, 32, and 33 provided on their respective seat plates in the interior space, thus decreasing the interior space or the entire size of the body 1 and contributing to the minimum size of the jack itself. Also, while the contact strip 31 is arranged on the U-shaped metal member 4, the remaining two contact strips 32 and 33 are only inserted into the body 1 from the rear end together with their respective seat plates 51 and 52 so that the entire length of the body 1 can be reduced in spite of the number of contact strips 31, 32, and 33, whereby the reduction in size of the jack will be accelerated.

Furthermore, the slit openings 26 and 27 of the body 1 are less in number than the contact strips 31, 32, and 33 and arranged shorter in the opening distance so as to minimize reduction in the physical strength of the body 1. The U-shaped metal member 4 also serves as a retainer for mounting the body 1 to a circuit board in a strap arrangement, allowing its leg portions 42, 42 to support both the side wall 20 and the opposite wall 23 of the body 1 in cooperation with the seat plates 51 and 52. This will assure that the strength required for the body 1 along with the previously described phenomenon of less reduction in the physical strength of the body 1 can be maintained, even if the jack becomes smaller in size with the outer walls of the body 1 being decreased in thickness.

The contact strip 31 is formed by liftedly cutting out a segment of the U-shaped metal member 4 and remains urged by a preload so that the elastic force of the contact strip 31 effectively acts on the contact 31*a*, ensuring higher reliability in the contact action of the contact point to a plug.

Although the contact strips of the jack are three in number as described in the embodiment, they may be two, four, or more. A jack having two, four, or more contacts is arranged in which at least one of the contacts is formed on a U-shaped metal member and the remaining contacts are formed on seat plates. While the U-shaped metal member is fitted onto a body of the jack, the contact formed integral with the U-shaped metal member extends into the interior space of the body through an opening provided in the upper surface of the same and the seat plates are inserted into the interior space of the body from the rear end.

What is claimed is:

1. An electrical jack for use with a plug having spaced apart contacts, comprising:

a body having upper, left-side, right-side, bottom, front and rear surfaces, said body defining an interior space into which the plug with its spaced apart contacts is inserted through said front surface, an opening in said upper surface and an opening in said rear surface each leading into said interior space;

at least one U-shaped metal member having a center portion and a leg portion extending from opposite sides of said center portion, each leg portion having a terminal extending outwardly therefrom, said metal member mounted astride said body with the center portion engaging said upper surface and the leg portions engaging a respective one of said left-side and right-side surfaces of said body, said center portion having a contact strip formed as a cut out segment thereof, said contact strip defining a contact which extends through the opening in said upper surface into said interior space; and at least one seat plate which extends through the opening in said rear surface into said interior space while defining an exposed rear end, said at least one seat plate having a terminal which extends outwardly therefrom and a contact strip defining a contact received in said interior space for engagement with a contact of the plug.

2. The electrical jack according to claim 1, wherein at least one surface of said body is interposed between a leg portion of said U-shaped metal member and a seat plate.

3. The electrical jack according to claim 1, wherein at least one surface of said body is interposed between a leg portion of said U-shaped metal member and the contact strip of a seat plate.

4. The electrical jack according to claim 1, wherein the contact strip of said U-shaped metal member comprises:

a planar segment of said center portion of said U-shaped metal member punched out and lifted up, with one end of said center portion being connected with the upper end of one of the leg portions, said planar segment being urged by a preload and supported by the upper surface of said body; and a contact portion provided on the distal end of said planar segment for insertion into said opening in said upper surface of said body.

5. The electrical jack according to claim 1, wherein each leg portion of said U-shaped metal member has an engaging opening therein for engagement with an engaging projection provided on the periphery of said body so as to fasten said U-shaped metal member to said body.

6. The electrical jack according to claim 1, wherein each leg portion of said U-shaped metal member has an engaging finger thereof for engagement with an engaging recess provided in the periphery of said body so as to fashion said U-shaped metal member to said body.

7. The electrical jack according to claim 1, wherein said seat plate has an engaging finger arranged on one end thereof for biting into the inner surface of said body so as to fasten said seat plate to said body.

8. The electrical jack according to claim 1, wherein the contact strip of said at least one seat plate is formed by punching out and lifting up a center segment of said seat plate.

9. The electrical jack according to claim 1, wherein the contact strip of said at least one seat plate is arranged to extend forward from said seat plate.

10. The electrical jack according to claim 1, further comprising:

a cover provide for closing the opening in said rear surface of said body and pushing against the rear end of said seat plate.

11. The electrical jack according to claim 10, wherein at least one surface of said body is interposed between a leg portion of said U-shaped metal member and a seat plate.

12. The electrical jack according to claim 10, wherein at least one surface of said body is interposed between a leg portion of said U-shaped metal member and the contact strip of a seat plate.

13. The electrical jack according to claim 12, wherein said cover has a tab provided for insertion into said body, thus allowing the seat plate to be interposed between a side surface of said body and the tab.

14. The electrical jack according to claim 11, wherein said cover has a tab provided for insertion into said body, thus allowing the seat plate to be interposed between a side surface of said body and the tab.

15. The electrical jack according to claim 14, wherein the contact strip of said U-shaped metal member is formed by:

punching out and lifting up a planar segment of said center portion of said U-shaped metal member, with one end of said center portion being connected with the upper end of one of the leg portions, said planar segment being urged by a preload and supported by the upper surface of said body; and providing a contact portion on the distal end of said planar segment for insertion into said opening in said upper surface of said body.

16. The electrical jack according to claim 15, wherein the contact strip of said at least one seat plate is formed by punching out and lifting up a center segment of said seat plate.

17. The electrical jack according to claim 15, wherein the contact strip of said at least one seat plate is arranged to extend forward from said seat plate.

18. The electrical jack according to claim 15, wherein said U-shaped metal member is fitted into continuous recesses provided in the upper, left-side, and right-side outer surfaces of said body.

19. The electrical jack according to claim 18, wherein each of the recesses in their respective left-side and right-side surfaces of said body incorporates grooves provided on both ends thereof for accepting the side ends of a leg portion of said U-shaped metal member.

20. The electrical jack according to claim 1, wherein said U-shaped metal member is fitted into continuous recesses provided in the upper, left-side, and right-side outer surfaces of said body.

21. The electrical jack according to claim 20, wherein each of the recesses in their respective left-side and right-side surfaces of said body incorporates grooves provided on both ends thereof for accepting the side ends of a leg portion of said U-shaped metal member.

22. The electrical jack according to claim 21, wherein each leg portion of said U-shaped metal member has an engaging opening therein for engagement with an engaging projection provided on the periphery of said body so as to fasten said U-shaped metal member to said body.

23. The electrical jack according to claim 22, wherein the contact strip of said U-shaped metal member comprises:

a planar segment of said center portion of said U-shaped metal member punched out and lifted up, with one end of said center portion being connected with the upper end of one of the leg portions, said planar segment being urged by a preload and supported by the upper surface of said body; and a contact portion provided on the distal end of said planar segment for insertion into said opening in said upper surface of said body.

* * * * *

UNITED STATES PATENT AND TRADEMARK OFFICE

CERTIFICATE OF CORRECTION

PATENT NO. : 5,092,795

DATED : March 3, 1992

INVENTOR(S) : Toshiya Kitagawa

It is certified that error appears in the above-identified patent and that said Letters Patent is hereby corrected as shown below:

Claim 6, column 7, line 64, "fashion" should be "fasten".

Signed and Sealed this

Twenty-fifth Day of May, 1993

*Attest:*

Michael K. Kirk

MICHAEL K. KIRK

*Attesting Officer*

*Acting Commissioner of Patents and Trademarks*